United States Patent [19]

Weber

[11] 4,154,499

[45] May 15, 1979

[54] ELECTRICAL CONNECTOR AND METHOD OF MAKING

[76] Inventor: Franz K. Weber, 15930 Royal Oak Rd., Encino, Calif. 91436

[21] Appl. No.: 805,026

[22] Filed: Jun. 9, 1977

Related U.S. Application Data

[60] Division of Ser. No. 562,337, Mar. 27, 1975, Pat. No. 4,107,770, which is a continuation-in-part of Ser. No. 459,906, Apr. 11, 1974, abandoned.

[51] Int. Cl.[2] ..... H01R 13/50

[52] U.S. Cl. ..... 339/193 N; 339/194 N; 339/198 C

[58] Field of Search ..... 339/20, 159 R, 193 N, 339/194 R, 194 N, 198 C, 198 H

[56] References Cited

U.S. PATENT DOCUMENTS

| | | | |
|---|---|---|---|
| 2,714,712 | 8/1955 | Riccardelli | 339/20 |
| 2,735,079 | 2/1956 | Passarelli | 339/20 |
| 2,986,621 | 5/1961 | Midgley | 339/198 H |
| 3,651,443 | 3/1972 | Quilez | 339/20 |

FOREIGN PATENT DOCUMENTS

| | | | |
|---|---|---|---|
| 440174 | 2/1927 | Fed. Rep. of Germany | 339/198 C |
| 644540 | 10/1950 | United Kingdom | 339/198 H |

*Primary Examiner*—Gerald A. Dost

*Attorney, Agent, or Firm*—Gene W. Arant

[57] ABSTRACT

An electrical connector includes a housing of generally cylindrical configuration having a plurality of windows formed in its circumferential wall, a spaced pair of generally ring-shaped distributor conductors disposed within the housing and accessible through the windows, and insulating means supporting the distributor conductors within the housing. The connector is adapted to receive a number of male plugs, each having its insulating base inserted within a corresponding one of the windows while its pair of flat contact blades engage respective ones of the generally ring-shaped conductor members.

An insulating spacer which separates the two ring-shaped conductor members is formed in two separate parts. Each conductor ring is attached to a corresponding insulating member, and then the two insulating members are fitted together.

The structure of each conductor ring, and its method of support, are such that the insertion of one contact blade causes the adjacent circumferential portion of the conductor ring to flex, in order to provide adequate contact pressure with the blade, but without affecting the operation of other circumferential portions of the conductor ring.

16 Claims, 10 Drawing Figures

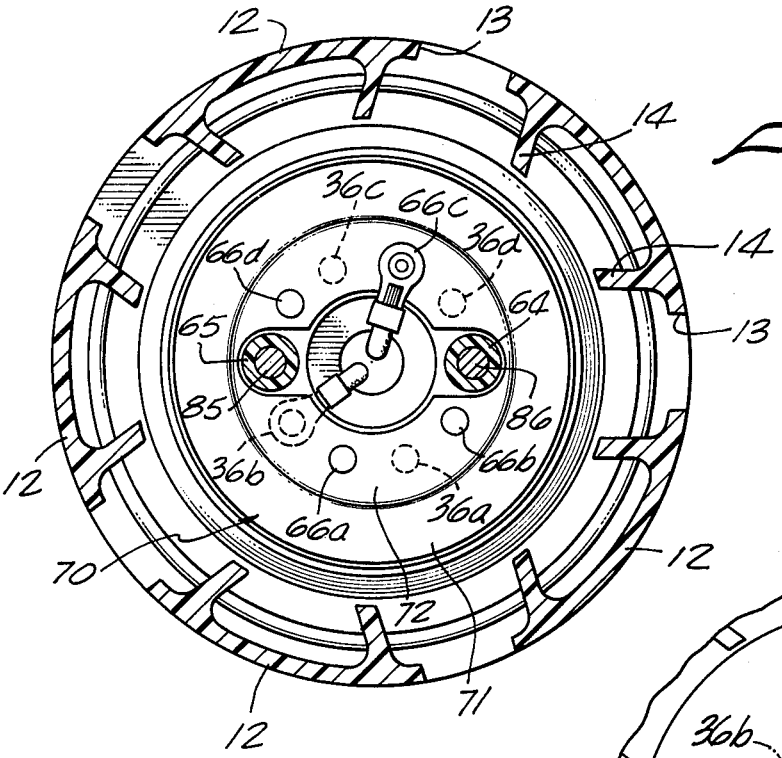
FIG. 4.
FIG. 5.
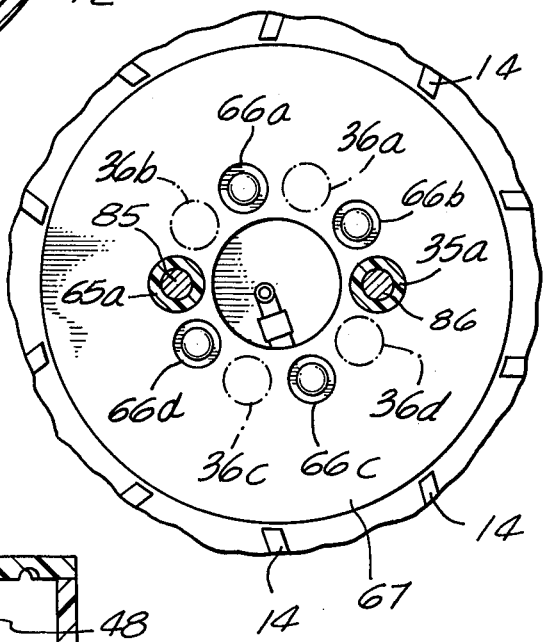
FIG. 6.
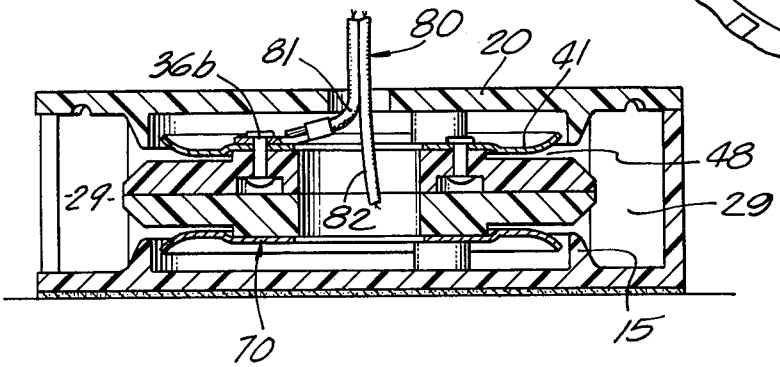
FIG. 7.
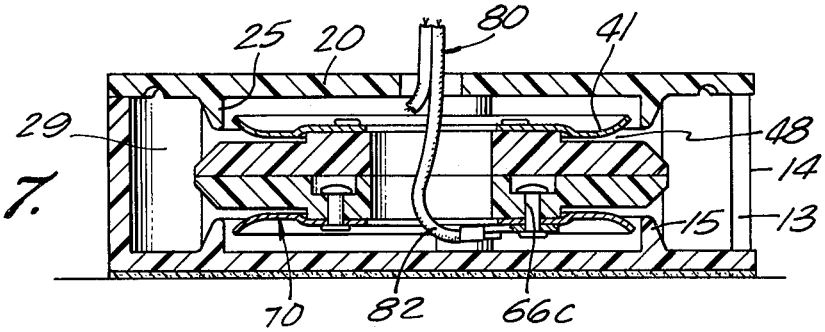

FIG. 8.
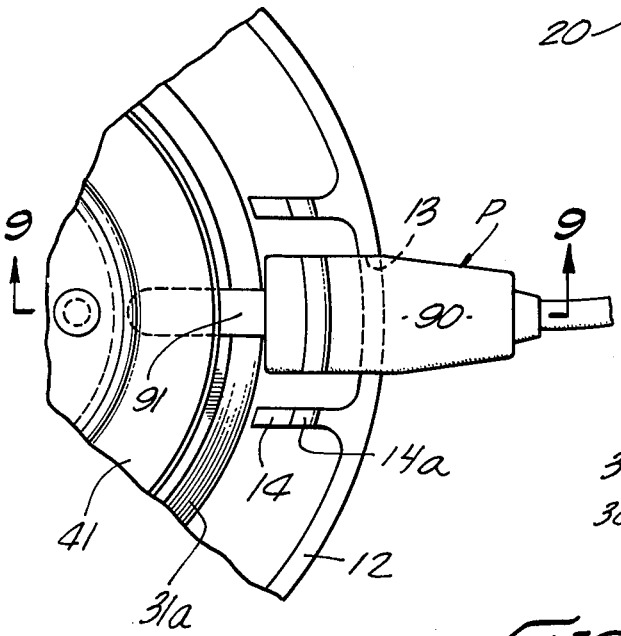
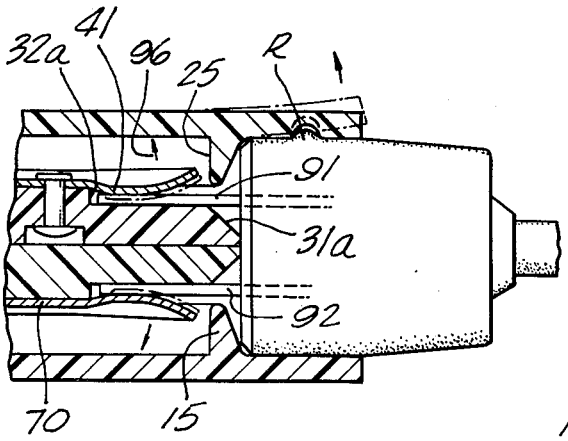
FIG. 9.
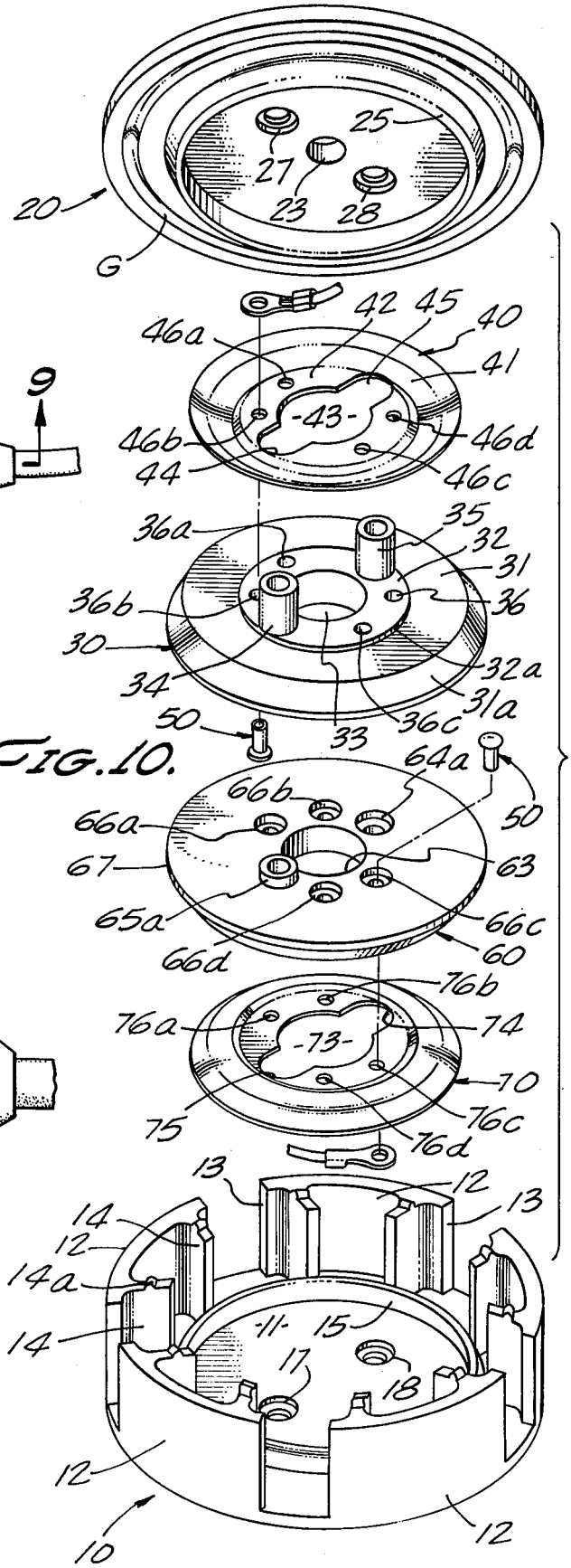
FIG. 10.

ELECTRICAL CONNECTOR AND METHOD OF MAKING

RELATED APPLICATION

The present application is both a division and a continuation in part of my copending application entitled "MODULAR CHANDELIER WITH PLUG-IN ARMS", Ser. No. 562,337, filed Mar. 27, 1975, now U.S. Pat. No. 4,107,770 which was a continuation-in-part of application Ser. No. 459,906 filed Apr. 11, 1974 and later abandoned. The drawings and specification of that patent are incorporated herein by reference, and particularly drawing FIGS. 16 through 33, inclusive, together with their accompanying description.

BACKGROUND OF THE INVENTION

In various situations it is advantageous to utilize an electrical connector which is mechanically arranged so that one or more of a relatively large number of separate circuits may be connected thereto as desired. The function of such a device is, in general, to distribute electrical current from a common source into several different branch circuits. The present invention relates to such a device incorporating a female type of mechanism, adapted to receive one or more male plugs for attachment of the branch circuits.

The first application of my present invention has been found in the central mechanism of a modular chandelier, as disclosed in my referenced patent. In that application each of the branch circuits is a separate chandelier arm which may be detached at will from the chandelier central body for cleaning or other purposes.

The invention will also be useful in homes, industrial plants, and the like, as an economical and convenient means for connecting more than two branch circuits to a single source of energy supply.

SUMMARY OF THE INVENTION

According to the general form of the invention, as shown in my referenced patent, a housing of generally cylindrical configuration has a plurality of windows formed in its circumferential wall, each window being preferably of rectangular configuration. A pair of generally flat circular conductor plates are supported in spaced parallel relationship within the housing by suitable insulating means. Specifically, an insulating spacer which is of flat circular configuration (or the configuration of a very short cylinder) is positioned between the conductor plates or rings to support them in their spaced relationship. The diameter of the spacer is preferably larger than the diameter of the conductor rings. The diameter of the housing, however, is considerably larger than the diameter of the spacer, so that an annular space exists within the housing around the conductor rings. The insulating base of a male plug may be inserted into a corresponding one of the windows, and the contact blades of the plug then engage respective ones of the conductor rings. Inward insertion of the insulating base of the male plug is limited by its engagement with the circumferential edge of the spacer.

More specifically, in the general form of the invention each metal conductor plate or ring is radially curved near its outer edge, with each plate or ring being curved away from the other plate or ring and hence also in a direction away from the spacer between the rings. The curved edge of the conductor ring therefore permits insertion of the corresponding contact blade between the ring and the spacer, in a manner that will provide substantial contact pressure and hence a good electrical contact.

Still referring to the general form of the invention, a fairly large central opening is formed in each of the conductor plates or rings and also in the insulating spacer that lies between them. A pair of insulated conductor wires for energizing the distributor are brought from one end of the assembly, with one wire being connected directly to the first ring while the other wire passes through the central opening in the distributor mechanism and is then connected to the other ring.

In the present drawings there is illustrated an improved and presently preferred embodiment of the invention. According to the improved form of the invention the spacer which separates the two conductor rings is horizontally bifurcated, and is therefore formed as two separate insulating members. Each conductor plate, rather than merely being sandwiched between the housing and the spacer, is now firmly secured to its associated insulating member. This improvement in the mechanism provides significant economy in the manufacturing process and also provides a significant improvement in the operating performance of the device.

More specifically, in the presently preferred form of the invention each conductor plate or ring has a circular central portion which is flat, and has a number of openings therein about its outer periphery for fastening by means of rivets or the like to the associated insulating member. The radially outer portion of the plate is first radially bent in one direction around the circumference of the flat central portion, and is then dished in the opposite direction. This configuration of the plate permits one circumferential portion to flex outward when slidingly engaged by a contact blade, without significantly affecting the operation of other circumferential portions of the plate.

DRAWING SUMMARY

FIG. 4 is a horizontal cross-sectional view of the distributor taken on line 4—4 of FIG. 2;

FIG. 5 is a horizontal cross-sectional view taken through the spacer along line 5—5 of FIG. 2;

FIG. 6 is a vertical cross-sectional view of the distributor taken on line 6—6 of FIG. 3;

FIG. 7 is a vertical cross-sectional view of the distributor taken on line 7—7 of FIG. 3;

FIG. 8 is a fragmentary top plan view of the distributor of FIG. 1, with lid removed and one plug inserted therein;

FIG. 9 is a vertical cross-sectional view of the complete distributor and plug taken on the line 9—9 of FIG. 8; and FIG. 10 is an exploded perspective view of the distributor.

PREFERRED EMBODIMENT (FIGS. 1-10)

Figure 1:
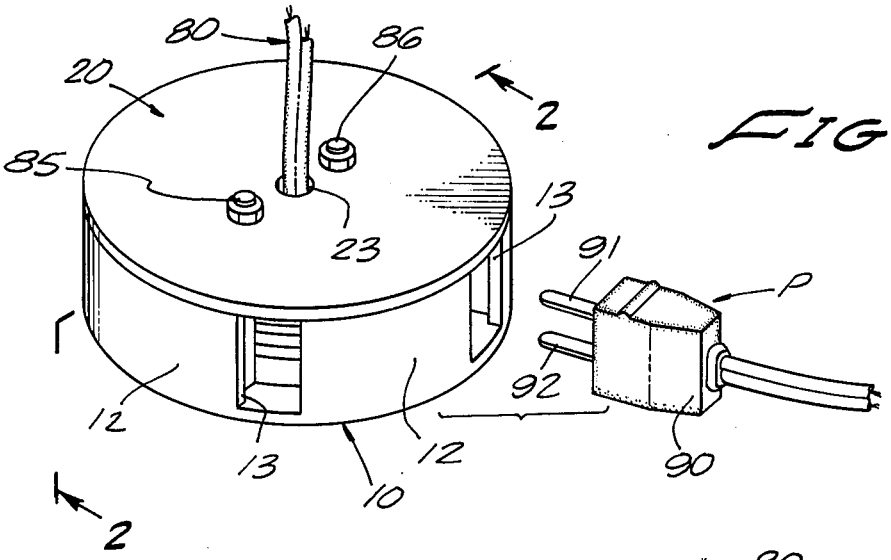
FIG. 1 is a perspective view of an electrical distributor in accordance with the invention, showing a plug about to be inserted therein.

Reference is first made to FIGS. 1 and 10 in order to explain the overall arrangement of the distributor of the present invention. A generally cup-shaped housing 10 shown in the lower part of FIG. 10 is covered by a flat circular lid 20 shown in the upper portion of the same drawing figure in order to provide a hollow enclosure having the configuration of a relatively short cylinder. Housing 10 has a bottom wall or base 11 from which five separate circumferential wall sections 12 rise upwardly. The wall sections 12 are spaced circumferentially apart and thereby form a set of five rectangular windows 13.

An upper insulating member 30 has an upper conductor ring 40 positioned above it, as shown in the exploded form of the apparatus in FIG. 10. Insulating member 30 has a flat circular upper surface 31 whose circular central portion 32 is raised forming a circumferential shoulder 32*a*. A relatively large central opening 33 is formed through the insulating member 30 at the center of raised surface 32. Hollow posts 34 and 35, positioned 180 degrees apart, rise upwardly from the raised surface 32. A set of four rivet holes 36*a*, 36*b*, 36*c*, 36*d* are formed in the raised surface 32, in circumferentially spaced positions lying on the locus of a circle, and pass vertically through the insulating member 30. The outer circumferential edge of surface 31 is angled downwardly at 31*a*.

Upper conductor ring or plate 40 has a flat circular central portion 42 which, in the assembled form of the mechanism, is co-extensive with the raised surface 32. A central opening 43 is enlarged at 44, 45 to fit about the posts 34, 35 as well as providing a continuation of the opening 33. The flat portion 42 of the ring also has rivet holes 46*a*, 46*b*, 46*c*, 46*d* which align with corresponding rivet holes in the insulating member 30.

A set of four rivets 50 are used to fasten the upper conductor ring 40 to the upper insulating member 30.

As shown in FIG. 10 in the exploded form of the mechanism, lower conductor ring 70 is positioned below the lower insulating member 60. While it is not immediately evident from FIG. 10, lower conductor ring 70 is identical to the upper conductor ring 40. Although even less evident, it is also true that lower insulating member 60 is identical to upper insulating member 30. A set of four rivets are also used to fasten lower insulating member 60 and lower conductor rings 70 together.

The under surface 37 of insulating member 30 is not shown in FIG. 10. The bottom ends of the rivet holes 36*a*. . . 36*d* are recessed. The corresponding recesses are shown in the under surface 67 of lower insulating member 60, which faces upwardly as seen in FIG. 10. The lower end of post 34 is recessed at 34*a* in under surface 37 of insulating member 30. The corresponding recess 64*a* is shown in the lower insulating member. Post 35 of the upper insulating member has a downward projection or extension 35*a*, and the corresponding post extension 65*a* is shown in the lower insulating member. Thus the post extension 65*a* of the lower insulating member is received in recess 34*a* of the upper insulating member, while post extension 35*a* of the upper insulating member is received in the post recess 64*a* of the lower insulating member. These interfitting protrusions and recesses permit the two insulating members to be removably fastened together in a fixed positional relationship to each other.

For fastening upper conductor ring 40 to upper insulating member 30, each rivet 50 has its head downward, being received by the recessed end of a corresponding one of the rivet holes 36*a* . . . 36*d*. For fastening lower conductor ring 70 to lower insulating member 60 the rivets 50 have their heads positioned upwardly. Reversal of the lower insulating member 60 relative to upper insulating member 30 causes the two sets of rivet holes to be non-aligned. The rivet holes are arranged non-symmetrically relative to the posts 34, 35 or 64, 65 in order to achieve this result. Thus as shown in FIG. 5 rivet hole 36*a* of the upper insulating member falls between rivet holes 66*a* and 66*b* of the lower insulating member, while rivet hole 36*b* falls between rivet hole 66*a* and the post 65*a*. In clockwise succession, rivet hole 66*b* is followed by post 35*a*, rivet hole 36*d*, rivet hole 66*c*, rivet hole 36*c*, rivet hole 66*d*, and post 65*a*. This non-alignment of the rivet holes eliminates any risk of arcing between the rivets fastened to the upper conductor ring and those fastened to the lower conductor ring.

In the housing 10, each circumferential wall section 12 is provided with a pair of internal ribs or flanges 14 which extend inwardly of the housing in a nearly radial direction. Each of the ribs 14 is provided with an upward projection 14*a*, best seen in FIG. 10. The projections 14*a* form the locus of a circle, and are received by a circumferential groove G in the under surface of lid 20, when the lid is positioned upon the housing. The ribs, rib projections, and lid groove provide a rigid mechanical support for each of the rectangular windows 13. A circular rim 15 is also formed on the upper surface of the bottom wall 11 of the housing 10, being located just inwardly of the ribs 14. This rim also adds to the rigidity of the housing structure, as well as serving as a guide for the lower contact blade of plug P (see FIG. 9). Specifically, rim 15 prevents the lower contact blade from being inserted into the distributor housing on the under side of the lower conductor ring 70.

Figure 2:
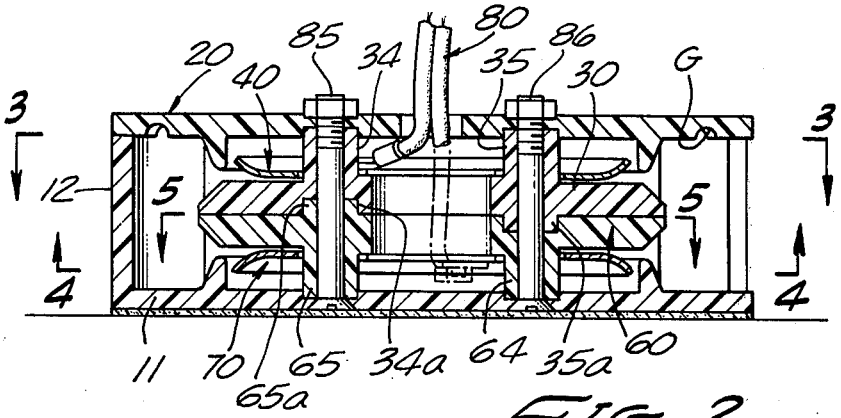
FIG. 2 is a vertical cross-sectional view of the distributor taken on line 2—2 of FIG. 1.
Figure 3:
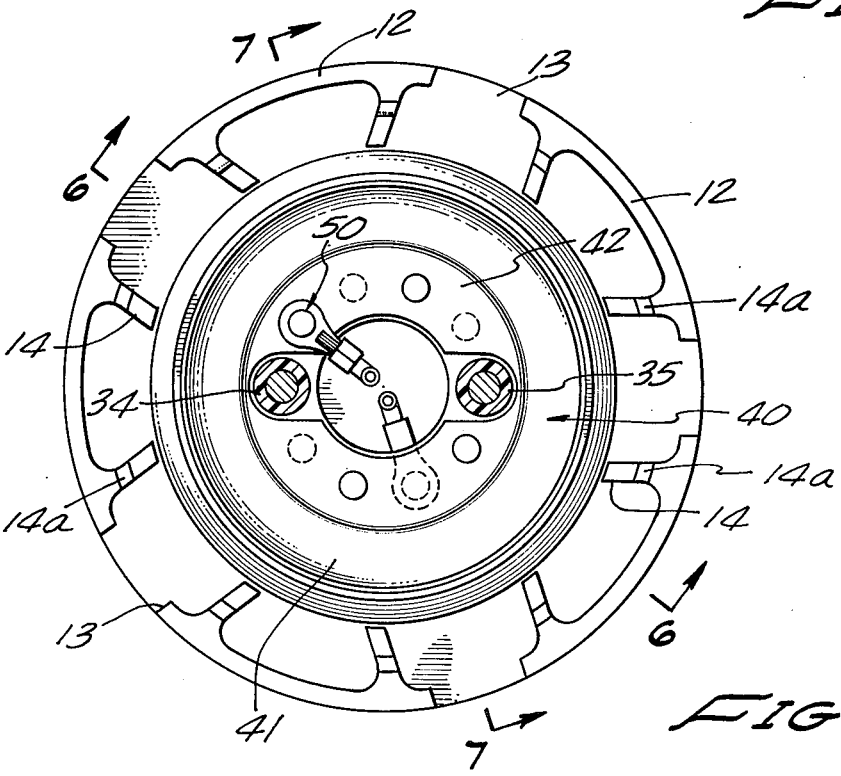
FIG. 3 is a horizontal cross-sectional view of the distributor taken on line 3—3 of FIG. 2.

Bottom wall 11 of housing 10 also has a pair of holes 17, 18 formed therein for supporting the posts of the spacer assembly. These holes have cylindrical recesses on the upper surface of bottom wall 11 for receiving the lower ends of posts 65, 64, respectively (see FIG. 2). They also have conically tapered recesses formed on the bottom surface of the bottom wall 11 for receiving the heads of bolts 85, 86, respectively.

Lid 20 on its under surface has a downwardly depending rim or flange 25 which is of the same size and configuration as the rim 15 of the housing, and located in alignment with it. Rib 25, besides adding to the structural rigidity of the lid, also performs the function of preventing the upper contact blade of plug P from being inserted into the housing enclosure above the upper conductor ring 40. Lid 20 also has holes 27, 28 formed therein, having associated cylindrical recesses on the under surfaces of the lid which receive the upper ends of posts 34, 35, respectively. Thus the fastening bolts 85, 86 pass through the bottom wall 11 of housing 10, the hollow interiors of posts 65 and 64 of lower insulating member 60, the hollow interiors of posts 34, 35 of upper insulating member 30, and the lid 20. The upper ends of the bolts are secured by nuts as shown in FIG. 1 in order to permanently secure the housing, spacer assembly, and lid firmly together.

Lid 20 also has a central hole 23 formed therein, which aligns with the holes 43, 33, 63, 73 of the electrical contact assemblies. An energizing circuit 80 (FIG. 1) enters the enclosure through hole 23. Conductor 81 has its bare end riveted to the upper surface of the upper conductor ring 40 at rivet hole 36b (see FIGS. 4 and 6). Conductor 82 extends through the interior of the spacer assembly and has its uninsulated end riveted to the under surface of lower conductor ring 70 at rivet hole 66c (see FIGS. 4, 6, and 7).

As best seen in FIGS. 6 and 7, and annular space 29 is formed between housing 10 and lid 20 on the exterior side of rims 15 and 25. This space is provided for the insertion of the insulating base of a male plug, as later described.

CIRCULAR CONTACT ASSEMBLY

It will be seen that the upper conductor ring 40 and upper insulating member 30 when riveted together form a circular contact assembly. Another identical assembly is formed by the lower conductor ring 70 and lower insulating member 60. For convenience in reference, the upper assembly only will be described in greater detail.

The radially outer portion of conductor ring 40 which extends beyond the flat central part 42 is designated as 41. As perhaps best seen in FIGS. 6 and 7, the ring portion 41 is spaced away from the flat circumferential shelf 31 that is provided by the upper insulating member 30. Central flat portion 42 of the conductor plate 40 is co-extensive with the raised central surface 32 of the insulating member, and is securely fastened down upon that surface by means of the four rivets 50. As it extends beyond the raised surface 32, however, the radially outer portion of conductor ring 40 is first radially bent downward, all around the circumference of the flat central portion of the ring. It is then bent in the opposite direction and dished upwardly. An annular space 48 is thereby provided between the ring portion 41 and the insulating member or spacer surface 31. The minimum width of the space 48 is, however, significantly less than the thickness of a contact blade to be inserted therein.

OPERATION

The operation of the distributor of the present invention is illustrated in conjunction with a plug P as shown in FIGS. 1, 8 and 9. Plug P has an insulating base 90 of rectangular cross-sectional configuration and which fits rather securely within one of the rectangular windows 13. Plug P also has a parallel pair of flat contact blades, including an upper blade 91 and a lower blade 92. Contact blade 91 engages the under surface of upper conductor ring 49 while contact blade 92 engages the upper surface of the lower conductor ring 70.

As previously described, the rims of flanges 15, 25 guide the contact blades so that they safely enter the annular spaces or cavities 48. The extent or distance to which insulating base 90 may be radially inserted into the distributor enclosure is limited by the flanges 15, 25 and even more so by the circumferential edges of the insulating members 30, 60. As shown in FIG. 9, the rims or flanges 15, 25 lie radially outside of the conductor rings 40, 70, and extend axially inwardly of the enclosure to about the elevation of the plane of the raised central surface 32 or 62 of the corresponding insulating member.

The dished curvature of the ring portion 41, however, is considerably greater than its reverse bend at the shoulder 32a, and hence the radial extremity of conductor plate 40 lies in a plane spaced significantly above plate central portion 42, and is well shielded behind the rim or flange 25.

The sloped surface 31a of insulating member 30 cooperates with rim or flanges 25 to guide the contact blade 91 into the annular cavity 48. A good sliding contact between the contact blade 91 and the conductor ring portion 41 is therefore assured. Insertion of the blade, however, causes the ring to flex upwardly, because the minimum width of the cavity was originally less than the thickness of the blade.

In actual practice the specific configuration and method of supporting the conductor ring have been found significant for the following reasons. It is essential that the distributor operate equally well whether one, two or five plugs are connected to it at a particular time. The metal conductor ring 40 has a limited ability to bend, and a much more limited ability to stretch. The reverse bend in the ring portion 41 as it passes radially beyond the shoulder 32a provides a biasing action which is reversed when the contact blade 91 enters the cavity. The upward bending of the ring portion 41 as shown by the arrow 96 in FIG. 9 has a significance which goes beyond the two dimensions there shown; a movement is also imparted to the circumferentially adjacent portions of the ring. The particular ring configuration as shown provides an effective contact pressure opposite each of the windows 13, but the flexing action of the ring opposite one window does not significantly interfere with its operation at the next window.

Ridge R provides a snap lock with the groove G. See FIG. 9. This action is made possible by an upward flexing of the portion of the lid 20 which lies radially beyond the rim 25. Once plug P is in place in the annular space 29, groove G again seats on the projections 14a of housing 10.

ALTERNATE FORMS

While the invention has been illustrated only in an ungrounded circuit, it may also be utilized with a grounded circuit if desired. For that purpose the inner surfaces of the insulating members 30, 60 may be appropriately modified to receive therebetween a grounding plate having appropriate terminal connections around its outer periphery.

While the housing 10, lid 20 and insulating members 30, 60 are preferably each integrally formed of plastic material, some or all of these parts may if desired be made of other materials.

The female receptacle is presently illustrated as having five windows for receiving five male plugs. However, either a larger or a smaller number of windows may be used if desired.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What Is claimed Is:

1. An electrical distributor assembly for receiving a plurality of male plugs, including a housing of generally cup-shaped configuration having a plurality of windows formed in circumferentially spaced positions in the exterior wall thereof, a generally flat circular insulating spacer disposed within said housing in horizontal alignment with said windows, and a pair of metal distributor conductor rings disposed upon the upper and lower surfaces, respectively, of said insulating spacer, characterized in that:

said insulating spacer is horizontally bifurcated to form two separate flat circular spacer members having protrusions and recesses on their mating surfaces to provide an interfitting relationship thereof; and each of said metal rings is permanently fastened to the corresponding one of said spacer members;

whereby in manufacturing the device two separate ring and spacer member assemblies may first be formed, and then said two spacer members may be fitted together before placing said spacer and said conductor rings within said housing.

2. A female electrical connector assembly for receiving a plurality of male plugs having prongs, comprising:

a generally cup-shaped housing including a generally flat circular base and an upstanding circumferential wall around the periphery of said base, said circumferential wall having a plurality of circumferentially spaced windows formed therein;

a generally flat circular cover positioned over said housing, whereby said housing and said cover cooperatively provide an enclosure;

a pair of generally flat circular metal conductor rings disposed in vertically spaced parallel relationship within said enclosure, the edges of said conductor rings being accessible through said windows of said housing;

a pair of generally flat circular insulator spacer members, one of said spacer members being permanently secured to the under surface of the upper one of said conductor rings, and the other of said spacer members being permanently secured to the upper surface of the lower one of said conductor rings, the adjoining surfaces of said spacer members having interfitting protrusions and recesses formed therein whereby said spacer members may be removably secured together in a fixed positional relationship; and support means cooperating with said enclosure and with said spacer members and conductor rings for supporting said spacer members and conductor rings in a fixed positional relationship within said housing.

3. The method of making a female electrical connector assembly containing a generally flat circular insulating spacer and a pair of generally flat circular conductor rings disposed on respective sides of the spacer, comprising the steps of:

selecting a pair of generally flat circular spacer members having substantially flat mating inner surfaces formed thereon, with interfitting protrusions and recesses, whereby said two spacer members may be fitted together to form the spacer;

selecting a pair of generally flat circular metal conductor rings;

placing each of said conductor rings upon the outer surface of a corresponding one of the spacer members;

then securely fastening each of the conductor rings to its associated spacer member; and thereafter fitting the two spacer members together in a fixed positional relationship to provide the insulating spacer and thereby form the assembly.

4. In an electrical connector, a generally circular contact assembly for receiving a plurality of contact blades in radially inserted positions, said contact assembly comprising:

a generally flat circular insulating member having on one flat surface thereof a raised circular central portion, a generally flat circular conductor plate disposed parallel to said one surface of said insulating member;

fastening means securing said conductor plate to said raised surface portion of said insulating member so that the radially outwardly extending portion of said conductor plate is spaced away from said insulating member, thereby forming an annular cavity for receiving the contact blades; and said radially outwardly extending portion of said conductor plate being first bent towards said insulating member and then, near its radial extremity, being bent away from it;

the minimum opening of said cavity being less than the thickness of a contact blade so that insertion of the blade causes the adjacent circumferential portion of said contact plate to flex away from said insulating member.

5. The contact assembly of claim 4 wherein said insulating member is of larger diameter than said conductor plate.

6. The contact assembly of claim 4 wherein a central opening is formed in both said insulating member and said conductor plate, in order to permit at least one conductor to pass through said contact assembly.

7. The contact assembly of claim 4 wherein said insulating member has a set of symmetrically arranged protrusions and depressions formed on its other flat surface, whereby two of said insulating members may be removably fitted together in a fixed positional relationship.

8. The contact assembly of claim 4 wherein said fastening means includes at least three rivets circumferentially spaced about the locus of a circle.

9. The contact assembly of claim 4 wherein said insulating member also has two posts integrally formed therewith which rise upwardly from said raised surface portion thereof, and said conductor plate has two mating holes formed therein which fit about respective ones of said posts.

10. The method of making a circular contact assembly for use in an electrical connector, comprising the steps of:

selecting a generally flat circular insulating member;

selecting a generally flat circular metal contact plate having a radially curved outer edge;

placing the plate upon the insulating member so that the curved edge of the plate curves away therefrom, thereby providing an annular space into which contact blades may be slidingly inserted in conductive engagement with the plate; and then riveting the central portion of the plate to the central portion of the insulating member.

11. In an electrical connector, means for supporting a pair of electrical contact plates in spaced, electrically insulating relationship, comprising:

an identical pair of generally thin flat insulating members, each having an inner surface and an outer surface;

said inner surface having a protrusion formed thereon and a complementary recess formed therein, whereby one of said members may be inverted relative to the other, said inner surfaces may be placed in mutual engagement, and the protrusion on each of said members will then fit within the recess of the other member so as to lock said two members in fixed positional relationship; and a plurality of holes formed through each of said members for fastening one of the contact plates on the outer surface thereof.

12. Support means as claimed in claim 11 wherein each of said fastening holes also has an annular recess at its inner end on the inner surface of the member, for receiving the head of an associated fastener.

13. Support means as claimed in claim 11 wherein said holes are unsymmetrically arranged, so that when said two members are assembled together the holes of each member are non-aligned with the holes of the other.

14. Support means as claimed in claim 11 which additionally includes a pair of posts rising from the outer surface of each said member, one post being aligned with said protrusion on the inner surface of the member and the other post being aligned with said recess on the inner surface of said member; each of said posts having a central hole extending entirely through said member, whereby when said two members are assembled together they may be secured by a pair of bolts inserted through respectively aligned pairs of said posts.

15. An electrical contact member comprising a metal plate of uniform thickness and continuous circular configuration and having a continuous outer edge, the central portion of said plate being flat and having a large central opening therein, the radially outer portion of said plate being first radially bent around the circumference of said flat central portion in a direction away from one side of said flat central portion and being then radially bent in the opposite direction and extending to and past the plane of said flat central portion such that the plane of its continuous outer edge is spaced a substantial distance away from the plane of said flat central portion and on the other side thereof.

16. The electrical contact member of claim 15 wherein said central portion also has at least three small openings formed therein along the locus of a circle about said central opening.

* * * * *